US009057521B2

(12) United States Patent
Marke

(10) Patent No.: US 9,057,521 B2
(45) Date of Patent: Jun. 16, 2015

(54) CANDLE AND WICK EXTINGUISHER USING THE EFFECT OF AIR PRESSURE

(76) Inventor: Wilhelm Marke, Sigmarszell (DE)

( * ) Notice: Subject to any disclaimer, the term of this patent is extended or adjusted under 35 U.S.C. 154(b) by 923 days.

(21) Appl. No.: 13/060,153

(22) PCT Filed: Aug. 25, 2009

(86) PCT No.: PCT/DE2009/001197

§ 371 (c)(1),
(2), (4) Date: May 12, 2011

(87) PCT Pub. No.: WO2010/022711

PCT Pub. Date: Mar. 4, 2010

(65) Prior Publication Data

US 2011/0281225 A1 Nov. 17, 2011

(30) Foreign Application Priority Data

Aug. 26, 2008 (DE) ..... 20 2008 011 350 U

(51) Int. Cl.
*F23Q 25/00* (2006.01)
*A62C 11/00* (2006.01)

(52) U.S. Cl.
CPC ..... *F23Q 25/00* (2013.01)

(58) Field of Classification Search
CPC ..... F23Q 25/00
USPC ..... 431/145
See application file for complete search history.

(56) References Cited

U.S. PATENT DOCUMENTS

| | | | | |
|---|---|---|---|---|
| 209,955 | A * | 11/1878 | Brandon | 431/145 |
| 225,350 | A * | 3/1880 | Dallery | 431/145 |
| 358,658 | A * | 3/1887 | Hall | 431/145 |
| 717,186 | A * | 12/1902 | Galipeau | 431/145 |
| 2,158,744 | A * | 5/1939 | Cormier | 431/145 |
| 2,785,556 | A * | 3/1957 | Smith | 431/145 |
| 2,794,868 | A * | 6/1957 | McMorran et al. | 200/34 |
| 2,923,285 | A * | 2/1960 | Salles | 124/63 |
| 3,656,252 | A * | 4/1972 | Sherman | 43/19 |
| 3,870,105 | A * | 3/1975 | Gooch | 169/33 |
| 3,940,587 | A * | 2/1976 | Oehry | 219/98 |
| 4,335,701 | A * | 6/1982 | Bozich | 124/26 |
| 5,344,309 | A * | 9/1994 | Phare | 431/145 |
| 5,845,749 | A * | 12/1998 | Moretz et al. | 188/281 |
| 2007/0006861 | A1* | 1/2007 | Sapir | 124/17 |
| 2007/0122758 | A1* | 5/2007 | Bloomfield | 431/153 |
| 2007/0231756 | A1* | 10/2007 | Valentine | 431/33 |
| 2008/0149353 | A1* | 6/2008 | Valentine | 169/46 |
| 2009/0043324 | A1* | 2/2009 | Paschal | 606/181 |
| 2011/0281224 | A1* | 11/2011 | Dickie | 431/143 |

FOREIGN PATENT DOCUMENTS

DE 3906148 A1 7/1989

OTHER PUBLICATIONS

The International Search Report of May 2, 2010.
International Search Report dated Feb. 5, 2010.

* cited by examiner

*Primary Examiner* — Gregory Huson
*Assistant Examiner* — Rabeeul Zuberi
(74) *Attorney, Agent, or Firm* — Cohen & Hildebrand, PLLC

(57) ABSTRACT

The invention relates to a candle extinguisher, characterized by an elongated base body having an integrated cylinder in which a burst of air pressure is produced with a piston, the piston being tensioned and triggered with an actuation lever.

12 Claims, 5 Drawing Sheets

CANDLE AND WICK EXTINGUISHER USING THE EFFECT OF AIR PRESSURE

Figure 1A:
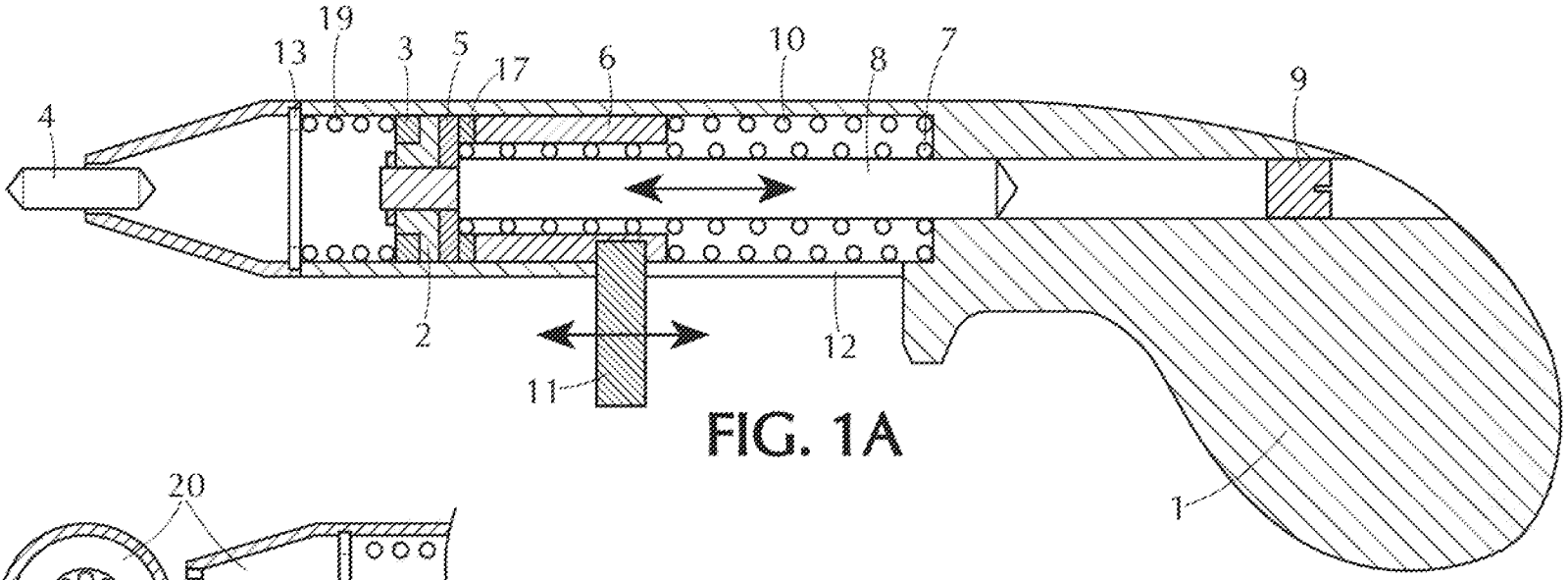
Figure 1B:
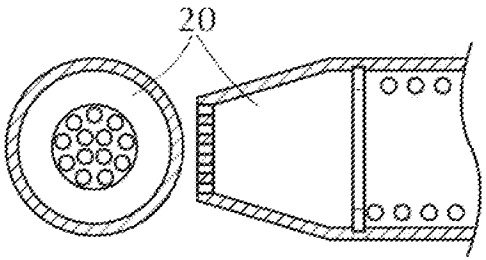
Figure 1C:
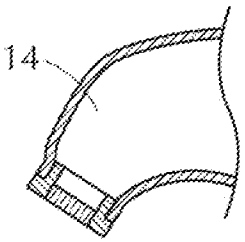
Figure 1D:
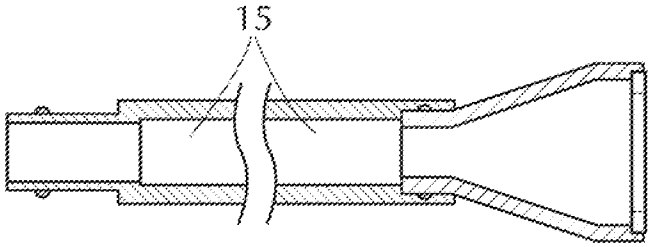

This is an application filed under 35 USC §371 of PCT/DE2009/001197, claiming priority to DE 20 2008 011 350.4 filed on Aug. 26, 2008.

BACKGROUND OF THE INVENTION (1) Field of the Invention

The invention relates to a candle and wick extinguisher using the effect of air pressure.

(2) Description of Related Art

Candles and other flames from a wick are generally extinguished by being blown out.

Extinguishers are known which have a bell and which suffocate the flame or molded wax article, thereby extinguishing the candle.

Also known are lids which are preferably placed over tea candle holders to suffocate the flame.

The disadvantages of the aforementioned methods are:

Blowing the flames out by mouth has limits due to the distances and the ensuing required unfavorable body posture and the positions of the candles or oil lanterns.

The bells are unsuitable for tea lights

The cover lids are only suitable for tea lights in containers and have limited applicability due to the diversity of the containers.

The molded wax articles are time-consuming to handle, are not contemporary and are not suitable for all applications (unfavorable positioning of the candles).

All these systems have one disadvantage in common: they do not take into consideration that the new stick lighters (also with flexible stick) make positions for candles achievable which cannot be reached with conventional lighters at all or only with great difficulty.

BRIEF SUMMARY OF THE INVENTION

It is an object of the invention to provide a device for extinguishing candles or wick flames, with which wick flames can be easily and reliably extinguished.

This object is attained according to the invention with a device having the features of claim 1.

Preferred embodiment and additional advantages of the invention are recited in the dependent claim, with particular reference being made here to their disclosure.

With the invention of the candle and wick extinguisher using the effect of air puffs, the aforementioned disadvantages can be obviates and the candles and other wick flames can be extinguished at any location by moving a finger, wherein wax splatter is avoided with the rapid burst of pressure due to the high viscosity of the wax.

BRIEF DESCRIPTION OF THE SEVERAL VIEWS OF THE DRAWING(S)

Exemplary embodiments of the invention, hereinafter referred to as candle extinguisher, will be described in FIGS. 1 to 5.

These show in

Figure 2:
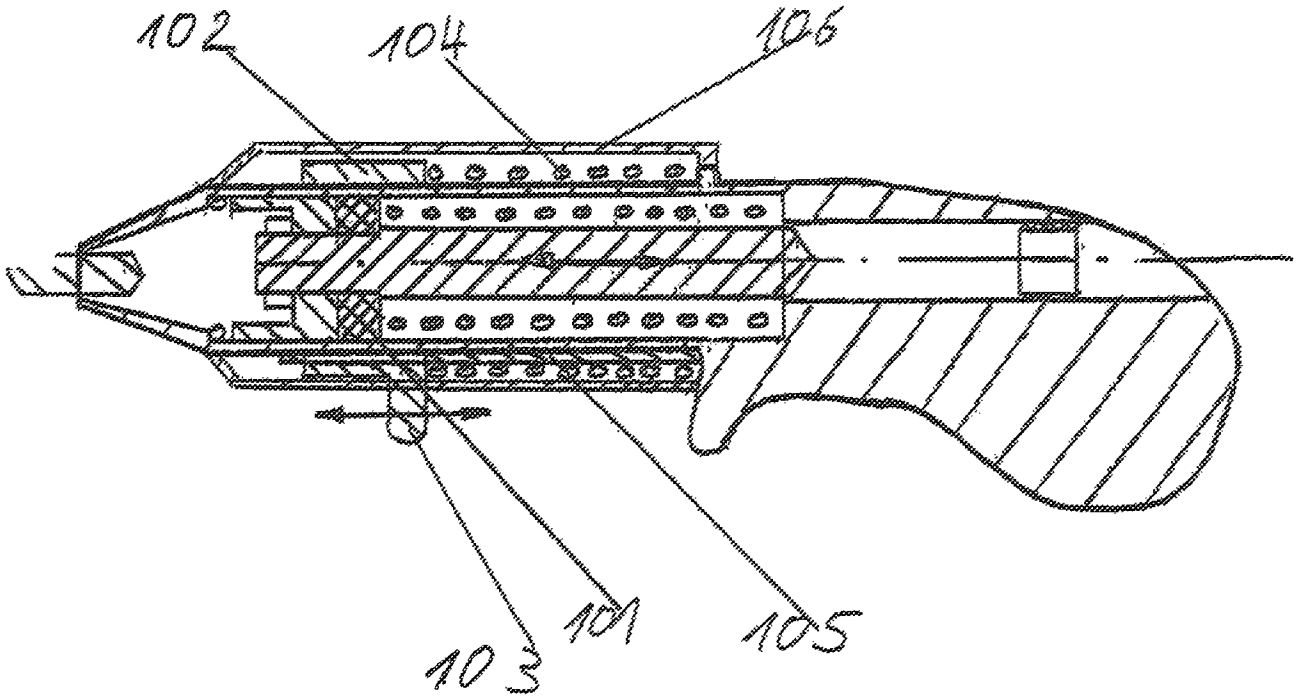
Figure 3:
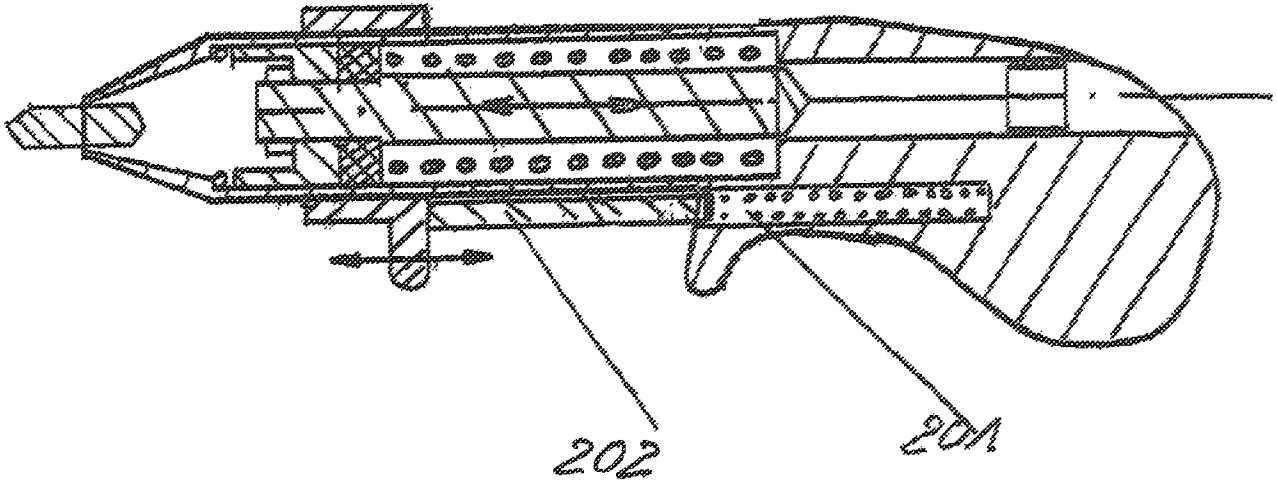
Figures 4A, 4B, 4C:
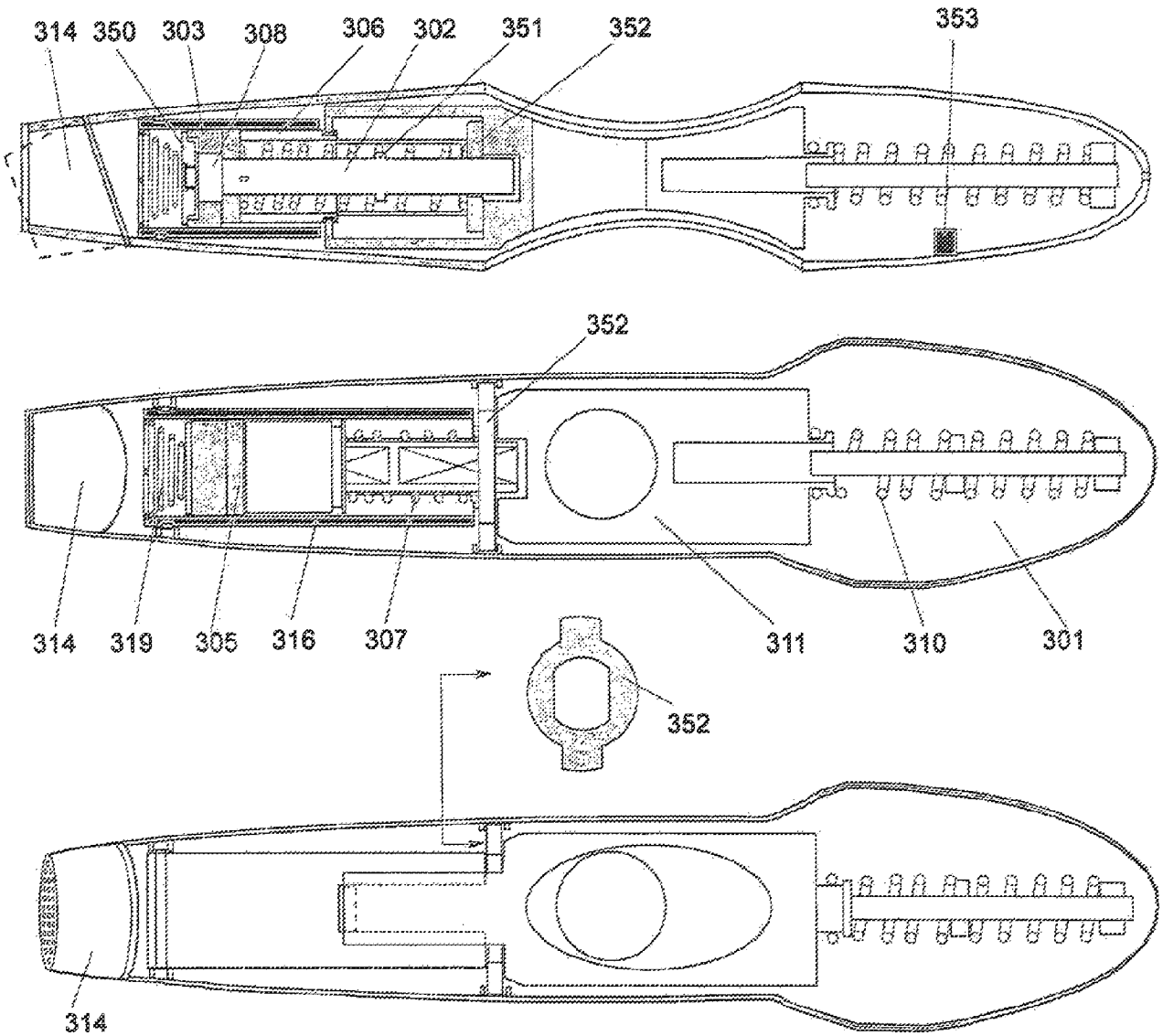
Figure 5:
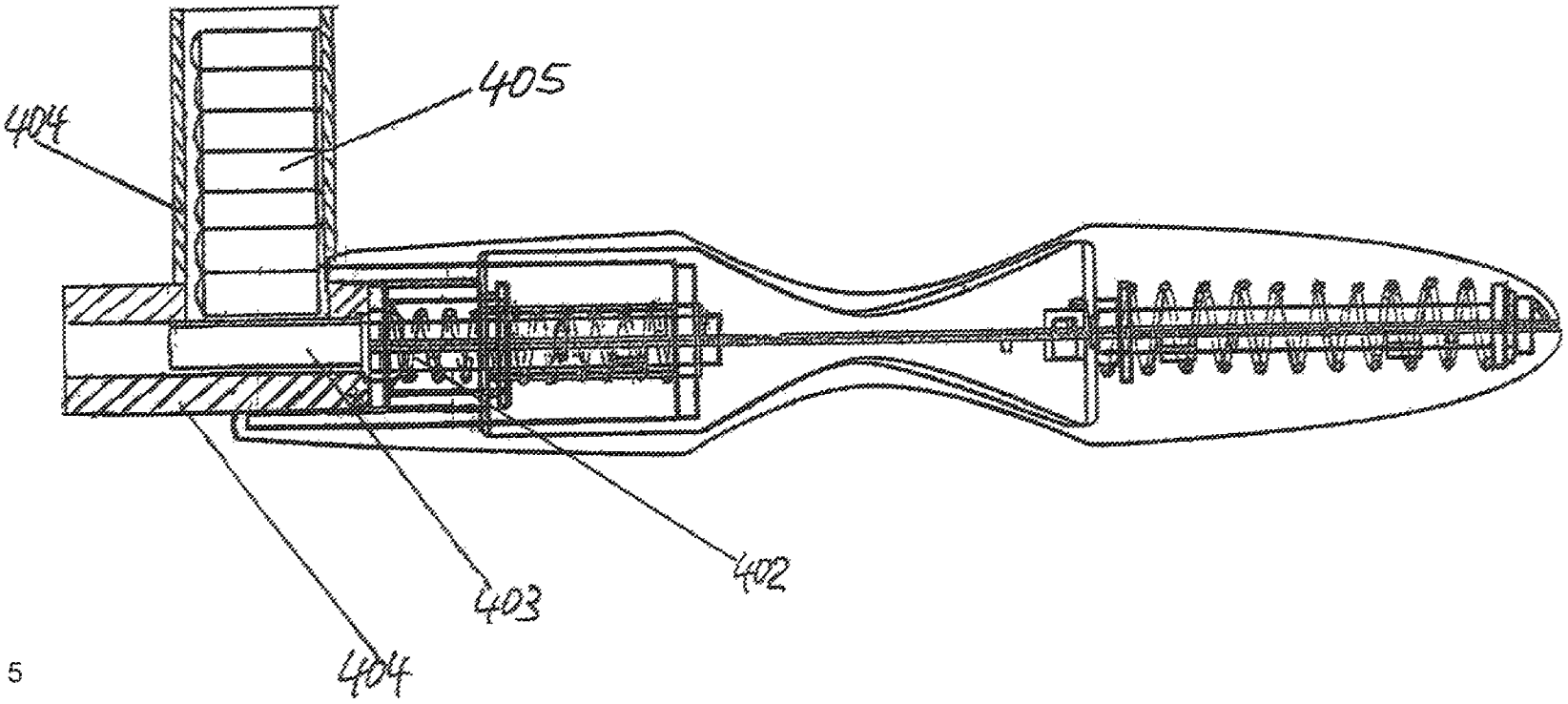

FIG. 1A-1D the candle extinguisher with an internal retractor and internal springs, FIG. 2 the candle extinguisher with an external retractor and an external return spring, FIG. 3 the candle extinguisher with an external retractor and a separate return spring, FIG. 4A-4C another embodiment of the candle extinguisher with an actuator integrated in the housing, and FIG. 5 a version with the same tensioning and release function, modified as a toy slingshot with repeat function, for shooting arrows or balls and the like, also with a cartridge.

DETAILED DESCRIPTION OF THE INVENTION

FIG. 1 shows the candle extinguisher having a longitudinal, ergonomically formed hand piece 1 with an integrated cylinder 16, in which an burst of air pressure is generated with a piston 2 and also a piston ring 3, 303. The piston 2 is movably arranged in the cylinder 16 and includes a piston rod 8 guided in the hand piece 1.

The cylinder 16 terminates on one side in a preferably conical nozzle which can also be formed as an annular nozzle 4 or a screen nozzle 20.

In the starting position, the piston 2 is located on the front end of the cylinder 16 facing the nozzle. The piston 2 is tensioned against a spring 10 by an axially magnetized holding magnet 5 which is fixedly installed on the piston 2, and a iron retractor 6. The spring 10 is located on a locating pin. The iron retractor 6 is retracted with an actuating lever 11. The magnet 5 adheres on the iron retractor 6 which carries along the magnet 5 and the piston 2 connected thereto. The iron retractor 6 can also be constructed in form of a ring 17 which is placed on a nonmagnetic molded part.

When the piston 2 is tensioned, the piston 2 together with the piston rod 8 moves to the right towards the handle of the hand piece 1. An adjustable limit stop 9, which the piston rod 8 strikes, is arranged in the handle of the hand piece 1. The magnet 5 is thereby abruptly released from the iron retractor 6 and thrust forward by the spring 7. The air residing in the cylinder 16 is abruptly compressed by the piston 2, causing a burst of pressure to exit the nozzle 14. The iron retractor 6 is then again automatically pressed forward into its starting position by an additional spring 7 and again rests against the magnet 5, so that the process can be repeated. The apparatus therefore operates with a repeating function.

The actuating lever 11 moves in a slit 12 in the cylinder and is operated in the same manner as a pistol.

The time of the release and hence the capacity of the candle extinguisher can be adapted to the individual requirements with the adjustable limit stop 9.

Angling of the nozzle 14 enables comfortable handling with tea lights. A full set of possible applications can be attained with extension adapters 15, which may be angled, bent or flexible.

A rubber ring 13 and/or a spring 19, 319 dampen the piston 2 at the end position during impact. The spring 19 also pushes the piston 2 back slightly, so that the magnet arrives at the retractor earlier, which shortens the travel of the actuating lever.

The optional annular nozzle 4 or screen nozzle 20 compresses the exiting air and increases the capacity and the accuracy due to the possible larger diameter of the nozzle.

FIG. 2 In this embodiment, an oppositely poled magnet 101 is employed and is moved inside the tube in the axial direction with an iron ring slider 102, which slides over the outside of the tube.

The actuating lever 103 is located on the ring slider.

The return spring 104 operates directly on the outside over the piston tube.

Axially guiding is achieved with a nut and spring system 105.

The ring slider 102 and the return spring 104 may operate below a cover 106.

FIG. 3 In this embodiment, the return spring 21 operates separately, wherein the push rod 22 is attached on the ring slider 102.

FIG. 4 This Figure shows an embodiment of the invention which is modified from FIG. 1. Identical elements or elements having an identical function are labeled with the same reference symbols as in FIG. 1, unless otherwise noted. Compared to FIG. 1, the value 300 is added to each reference symbol.

In this version, the actuating mechanism is integrated in the hand piece 31 (housing). The trigger is constructed as a finger opening 311 in the housing 301. The iron retractor 306 is moved by retracting the trigger with the finger. The magnet 305 is carried along by the iron retractor 306. Consequently, the piston assembly 308 consisting of the piston rod 302, the piston ring 303, the magnet 305, the damping ring 350, are tensioned against the spring 307. A release protrusion 351 arranged on the piston rod 302 then strikes a partition 352 which is fixedly arranged in the hand piece 301. The release protrusion is formed, for example, by flat portions disposed on the piston rod 302. As a result, the magnet 305 is abruptly detached from the iron retractor 306, with the force from the spring 310 thrusting the piston assembly 308 forward in a cylinder 316. The air in the cylinder 316 is compressed and thereby generates an burst of air pressure which exits the nozzle 314. The damping spring 319 has a conical structure and can therefore be compressed down to the thickness of the spring wire. This lengthens the travel of the piston assembly 308 and increases of the pressure capacity.

The angle of the nozzle 314 can be continuously adjusted through axial rotation. The limit stop 353 prevents further pullback of the trigger 311 after release.

FIG. 5 shows a version with the same tensioning and release function as FIG. 4, modified here as a toy repetition slingshot for shooting arrows, balls and the like, optionally also with a cartridge.

With the push rod 403 optionally attached on the piston 402, which shoots forward in the barrel 404 employing the disclosed mechanism, arrows 403 or balls and the like can be shot with the repeat function in rapid succession, wherein the ammunition 405 residing in the cartridge 404 slides down or is pressed on with a spring.

LIST OF REFERENCE SYMBOLS

1, 301 Hand piece
2, 302 Piston rod
3, 303 Piston ring
4, 314 Ring nozzle
5, 305 Magnet
6, 306 Iron retractor
7, 307 Spring
8, 308 Piston assembly
10, 310 Spring (rear)
11, 311 Actuating lever
12 Slit
13 Rubber ring
14, 314 Nozzle
15 Extension
16, 316 Cylinder
19, 319 Spring
350 Damping ring
351 Trigger cam
352 Partition
353 Limit stop
454 Flat region

The invention claimed is:

1. A candle extinguisher comprising:

a hand piece, a cylinder in the hand piece, a piston assembly movably disposed within the cylinder, the piston assembly including a piston and a piston rod, the piston together with a magnet and a retractor made of iron being movable within the cylinder, an actuating lever is attached to the retractor for tensioning the piston in a first direction against a spring, and the retractor being abruptly releasable from the magnet upon the piston rod striking a limit stop thrusting the magnet together with the piston in a second direction opposite the first direction generating a burst of air pressure that exits from the cylinder, wherein the iron retractor is constructed as a ring which is seated on a plastic part or on another nonmagnetic material, wherein the piston and the magnet are connected with the piston rod, wherein a tension spring is disposed on the piston rod, wherein the limit stop is axially adjustable in a direction of travel of the piston and disposed in the hand piece.

2. A candle extinguisher comprising:

a hand piece, a cylinder in the hand piece, a piston assembly movably disposed within the cylinder, the piston assembly including a piston and a piston rod, the piston together with a magnet and a retractor made of iron being movable within the cylinder, an actuating lever is attached to the retractor for tensioning the piston in a first direction against a spring, and the retractor being abruptly releasable from the magnet upon the piston rod striking a limit stop thrusting the magnet together with the piston in a second direction opposite the first direction generating a burst of air pressure that exits from the cylinder, wherein the iron retractor is constructed as a ring which is seated on a plastic part or on another nonmagnetic material, wherein the piston and the magnet are connected with the piston rod, wherein a tension spring is disposed on the piston rod, wherein the piston rod comprises a release protrusion which strikes against a partition fixedly integrated in the hand piece and releases the magnet from the iron retractor.

3. The candle extinguisher according to claim 2, wherein the cylinder is constructed as a separate tube which is inserted in the hand piece.

4. The candle extinguisher according to claim 2, wherein the piston or the piston assembly comprises a rubber or plastic molded part, which seals against the cylinder wall.

5. The candle extinguisher according to claim 2, wherein the piston is fixedly coupled to the magnet.

6. The candle extinguisher according to claim 2, wherein an operating lever is attached on the iron retractor.

7. The candle extinguisher according to claim 6, wherein a return spring inserted in the cylinder moves the iron retractor forward towards the magnet.

8. The candle extinguisher according to claim 7, wherein the cylinder terminates in a nozzle.

9. The candle extinguisher according to claim 8, wherein the nozzle forms a projection, on which extensions are attachable.

10. The candle extinguisher according to claim 9, further comprising a damping ring made from an elastic material a damping spring which are located in the cylinder.

11. The candle extinguisher according to claim 10, wherein the piston is the magnet.

12. The candle extinguisher according to claim 11, wherein the springs and the piston further comprises an internal rubber or plastic molded pan which is tensioned by the magnet and produces the burst of air during abrupt release from the magnet.

* * * * *

UNITED STATES PATENT AND TRADEMARK OFFICE

CERTIFICATE OF CORRECTION

PATENT NO. : 9,057,521 B2
APPLICATION NO. : 13/060153
DATED : June 16, 2015
INVENTOR(S) : Wilhelm Marke It is certified that error appears in the above-identified patent and that said Letters Patent is hereby corrected as shown below:

Claims:

Col. 5, claim 12, line 3, change “pan” to --part--.

Signed and Sealed this
Thirteenth Day of October, 2015

Michelle K. Lee

Michelle K. Lee
*Director of the United States Patent and Trademark Office*